US005180338A

United States Patent [19]

Pinto

[11] Patent Number: 5,180,338

[45] Date of Patent: Jan. 19, 1993

[54] RIDING TOY MECHANISM

[76] Inventor: Albert A. Pinto, 15 Branford Ct., Avon, Conn. 06001

[21] Appl. No.: 869,240

[22] Filed: Apr. 15, 1992

Related U.S. Application Data

[63] Continuation-in-part of Ser. No. 573,367, Aug. 27, 1990, abandoned.

[51] Int. Cl.[5] ..... A63G 17/00

[52] U.S. Cl. ..... 472/96; 472/95; 472/101; 472/103

[58] Field of Search ..... 472/95–105, 472/108, 110

[56] References Cited

U.S. PATENT DOCUMENTS

| | | | |
|---|---|---|---|
| 542,850 | 7/1895 | Garben | 472/104 |
| 710,218 | 9/1902 | Seng | 472/96 |
| 1,510,316 | 9/1924 | Gentry | 472/96 |
| 1,730,557 | 10/1929 | Brackett | 472/96 |
| 1,854,059 | 4/1932 | Paris | 472/105 |
| 2,007,852 | 7/1935 | Fuller | 472/105 |
| 2,668,579 | 2/1954 | Swengel | 472/105 |

*Primary Examiner*—Richard E. Chilcot, Jr.

*Attorney, Agent, or Firm*—Victor E. Libert; Frederick A. Spaeth

[57] ABSTRACT

A riding toy mechanism which provides both lateral and vertical reciprocating motion in which the amplitude of the vertical reciporcating motion is not determined by the amplitude of the lateral reciprocating motion. The mechanism includes a slide member (20) slidably mounted on the mechanism, a pivot member (24) pivotably mounted on the mechanism, and dual reciprocating means (28) for imparting harmonic lateral reciprocating motion to slide member (20) and independent vertical pivoting motion to pivot member (24). Dual reciprocating means (28) may include a cam (30) mounted to pivot member (24), a drive gear (31) for rotating the cam (30), and a connecting rod (32) pivotably and eccentrically attached at one end to one of the cam (30) and the drive gear (31) and at the other end and to mooring means (17). The mechanism includes cam follower means (40) upon which cam (30) rests. Rotation of cam (30) thus imparts harmonic lateral reciprocating motion to slide member (20) and independent vertical pivoting motion to pivot member (24). In another embodiment, alternate slide member (58) is slidably mounted on alternate pivot member (60), which is pivotably mounted to a stationary support member (12).

18 Claims, 10 Drawing Sheets

RIDING TOY MECHANISM

BACKGROUND OF THE INVENTION

1. Field Of The Invention

This invention relates generally to a riding toy mechanism and more specifically to a mechanism which provides a compound reciprocating motion to the rider.

2. Related Art

Riding toy mechanisms of the prior art commonly derive reciprocating motion from the regular oscillation of crank shafts, gears or pulleys operated by the user's feet or by a motor. For example, U.S. Pat. No. 3,068,000 to Hanson discloses a foot operated riding toy having a seat which has a forward end and a rearward end, both of which are mounted by offset shaft members on crank shafts to which a central crank shaft is connected by connector rods. Pedals allow the user to rotate the central crank shaft, and thereby, the forward and rearward crank shafts, thus imparting reciprocating motion to the seat member. The amplitude of the reciprocating motion imparted to the seat is determined by the length of the offset shaft members. Since this length is fixed, the motion imparted to the seat member at the point where it is connected to the offset shaft will be circular, and the vertical and horizontal or lateral components thereof have mutually dependent amplitudes. The rate at which the seat member goes through the circular reciprocation, and therefore the frequency of the vertical and horizontal reciprocation motions, will be determined by the rotational speed of the central crank shaft driven by the user's feet.

The common use of crank shafts, regular (i.e., round) gears, and reciprocating drives impart to the riding toys of the prior art a common characteristic. This is that the motion of the riding toy, as imparted to its seat member, and therefore the motion experienced by its rider, is determined by a circular path of travel, or a combination of circular paths of travel, imposed on the toy by the rotation of its driving crank, gear or pulley. When a single circular motion drives the seat member, the lateral and vertical components thereof have the same profile, i.e., are sinusoidal, and out of phase by 90 degrees. The amplitude of the vertical motion is thus dependent upon or coupled with that of the lateral motion. Both motions, and the overall motion of the drive, are described as harmonic because they derive from circular motion or components thereof.

A similar motion is seen in the hobby horse disclosed by Jensen, U.S. Pat. No. 2,473,649 in which the saddle is mounted on forward and rearward support members which are mounted to the offset portions of forward and rearward crank shafts. A pedal driven sprocket assembly drives the crank shafts by a drive chain. As with the device disclosed by Hanson, Jensen's hobby horse moves in a circular pattern in which the amplitude and frequency of the lateral and vertical reciprocating motions are the same, but 90 degrees out of phase.

British Patent Specification 742,295 to Berry discloses a dual drive mechanical horse mechanism in which the forward end is pivotably mounted to a pair of motor-driven crank-mounted support poles through a linkage which allows the horse to rock to-and-fro. At the rear end, the horse is mounted to a second motor-driven crank which imposes a circular motion on the rear end of the horse, with the associated, mutually coupled lateral and vertical reciprocating motions. The configuration of the support poles causes vertical reciprocating motion to be imposed upon the front end of the horse with a minimum of associated lateral motion. While the motion of this riding toy is slightly more complex than that of the device disclosed by Hanson and Jensen, it still suffers from the same principal limitation, i.e., that the lateral and vertical components of motion derive from purely circular driving mechanisms and are therefore mutually dependent. In this case, the amplitude of the vertical reciprocating motion is the sum of the vertical components of two circular motions, and is in this sense a harmonic, if not sinusoidal, motion.

The prior art includes a variation on the previously discussed reciprocating motion in the disclosure of Goodrich, U.S. Pat. No. 1,647,616. Goodrich provides a saddle member which is pivotably mounted to a support. An extension bar extends forwardly from the saddle member and is attached to a reciprocating rod and pulley assembly. The saddle member may therefore rock to-and-fro in response to the reciprocation assembly, but, because it is pivotably mounted, cannot provide vertical motion. However, Goodrich provides oblique motion through the use of linkage 102 connected to the saddle member by universal joint 101 and to the pivot shaft 21. This linkage provides a sideward motion coordinated with the rocking of the saddle member to simulate the swagger of the rear end of a horse. The swagger motion and the rocking motion in the device disclosed by Goodrich are supplied by different motors, so the respective frequencies thereof are mutually independent, but they are both sinusoidal.

U.S. Pat. No. 710,218 to J. Seng discloses a hobby horse which is pivotably mounted to a stationary support. The horse is also attached via a pivotable linkage to a crank shaft which is driven by pedals operated by the user to produce a to-and-fro rocking motion. In this case, only one degree of freedom, i.e., rotation about the pivot mounting, is allowed.

Some riding mechanisms in the prior art are not mounted to stationary supports, and are designed to advance in a forward motion as the user operates the device. For example, U.S. Pat. No. 1,819,029 to King et al discloses a pedal-driven mechanical toy horse including a drive gear which causes the legs of the device to extend and retract. The legs are equipped with wheels which are movable between two positions, one in which the wheel turns easily while the leg is extending forward and one in which the wheel is braked, while the leg is retracting. In this way, the mechanism advances as the user operates the pedals.

U.S. Pat. No. 2,237,605 to Maypole discloses a moving mechanical horse on which the legs are all provided with wheels having clutch means, and the rear legs extend and retract in response to the user's application of pressure to a stirrup mechanism. By coordinating operation of the respective clutch mechanisms of the front and rear wheels the horse advances in response to the user's operation. In such moving mechanical horses, the clutch mechanisms in the wheels operate to prevent lateral reciprocation; simple straightforward motion is attained instead. Slight vertical oscillation is provided, but the amplitude thereof is determined by the degree of extension and retraction of the legs of the device.

SUMMARY OF THE INVENTION

In accordance with the present invention, there is provided a riding toy mechanism comprising a stationary support means, a slide member slidably mounted to the mechanism, a pivot member pivotably mounted to the mechanism, and dual reciprocating means for simultaneously inducing lateral reciprocating motion to at least the slide member and vertical pivoting motion to at least the pivot member, wherein the amplitude of the vertical pivoting motion is independent of the amplitude of the lateral reciprocating motion. The invention further comprises power means mounted on the mechanism and engaged with the dual reciprocating means, to operate the mechanism.

In one embodiment, the slide member is slidably mounted to the stationary support and the pivot member is pivotably mounted to the slide member. Alternatively, the slide member may be slidably mounted on the pivot member, and the pivot member may be pivotably mounted to the stationary support.

According to one aspect of the instant invention, the dual reciprocating means comprises a drive member rotatably mounted on the pivot member, an eccentric rotatable member, such as a cam, rotatably mounted on the pivot member and coupled to the drive means whereby rotation of the drive means causes rotation of the eccentric rotatable member, and a connector bar having two ends with one end pivotably and eccentrically attached to one of the eccentric rotatable member and the drive member and the other end pivotably attached to a mooring means. The mooring means may be secured to the stationary support means or any other structure which is stationary relative to the slide member, and imparts lateral reciprocating motion to the slide member when the drive member rotates. The dual reciprocating means further comprises a follower means mounted on one of the slide member and the support member in engagement with the periphery of the eccentric rotatable member. So configured, rotation of the rotatable member imparts harmonic lateral reciprocating motion to the slide member by virtue of the connector bar being pivotably fixed to the mooring means, and imparts a vertical pivoting motion to the pivot member relative to the slide member. The vertical pivoting motion thus produced has an amplitude which is not determined by, and is therefore independent of, the amplitude of the lateral reciprocating motion.

According to one aspect of this invention, the follower means may comprise a cam follower mounted on the slide member. Alternatively, the follower means may comprise a follower surface on the support means.

In an alternative embodiment of this invention, the dual reciprocating means may comprise a cam follower mounted on the pivot member and a cam surface on a support means on which the cam follower rides.

In yet another embodiment of the present invention, the drive member is a driving gear and the eccentric rotatable member is an eccentric idler gear mounted on the slide member, on which the driving gear engagably rests.

According to still another aspect of the present invention, the riding toy mechanism comprises a stationary support, a slide member slidably mounted on the mechanism, a pivot member pivotably mounted on the mechanism and lateral reciprocating means operably disposed between a mooring means and one of the slide member and the pivot member, for imparting lateral reciprocating motion to at least the slide member. The mechanism further comprises vertical pivoting means operably disposed between the pivot member and one of the slide member and the stationary support means, for vertical pivoting motion to the pivot member in response to the operation of the lateral reciprocating means. The amplitude of the vertical pivoting motion is independent of the amplitude of the lateral reciprocating motion. In this case, the lateral reciprocating means may comprise a rotatable drive member mounted on one of the pivot member and the slide member, and connecting means having two ends with one end eccentrically and pivotably attached to the rotatable drive member and the other end pivotably attached to the mooring means. The vertical pivoting means may comprise a peripherally eccentric cam mounted on one of the pivot member and the slide member in driving relation to the driving gear. Where the follower means is on the slide member, it may comprise a cam follower on which the cam rests. On the other hand, the follower means may comprise a follower surface on the support means. In an alternative embodiment, the drive member may be a driving gear on the pivot member and the vertical pivoting means may comprise a peripherally eccentric idler gear pivotably mounted on the slide member in engagement with the driving gear.

According to yet another aspect of the present invention, the pivot member may be pivotably mounted to the support, the slide member may be slidably mounted to the pivot member, and the dual reciprocating means may impart lateral reciprocating motion to the slide member and independent vertical pivoting motion to the pivot member. The dual reciprocating means may comprise a drive member rotatably mounted on the slide member, a connector means having two ends with one end pivotably and eccentrically attached to the drive member and the other end pivotably attached to the support, and may further comprise a follower member mounted on the slide member. The dual reciprocating means further comprises a cam surface on the support, on which the cam follower rides.

To accommodate the slide member, one of the support means and the pivot member may include track means; such track means may comprise a pair of slide bars, and the slide member may include at least two bores to receive the slide bars.

In any of the embodiments, the power means may comprise pedals to drive a pedal gear to drive the drive member by foot. In lieu of foot operation by the user, the power means may comprise motor drive means, e.g., an electric motor, for driving the rotatable drive member. One of the pivot member and the slide member may carry a saddle shell to accommodate a user.

As used herein "harmonic" means motions having amplitudes which derive from a linear component of circular motion, i.e., which have a sinusoidal amplitude in relation to the degree of rotation of a driving rotatable member, and includes those motions whose amplitudes result from a combination of such components; "anharmonic" means motions which are not harmonic, i.e., those whose amplitudes are not determined as a component of a circular motion.

DETAILED DESCRIPTION OF THE INVENTION AND PREFERRED EMBODIMENTS THEREOF

Generally, the present invention relates to a mechanism for use in a riding toy, to impart both a to-and-fro motion and an up-and-down motion to the riding toy. The amplitude and period of the to-and-fro motion (or "lateral reciprocating motion" as sensed from a side view) is not inextricably coupled to the amplitude and period of the up-and-down motion, as with riding toy mechanisms of the prior art. To accommodate these different motions, the riding toy mechanism of the present invention comprises two movement members, a slide member which moves to-and-fro and a pivot member which moves up-and-down. One movement member is mounted directly to a stationary support, and the other movement member is mounted on the first. The user rides upon the second movement member to experience the dual reciprocating motion provided by the mechanism. Preferably, the second movement member is covered with a saddle shell in the shape of a horse or other aesthetically appealing riding object. The shell is configured to provide the necessary clearance within its interior so that it does not inhibit the movements of the riding toy mechanism, and, preferably, to enclose the mechanism from the user, to prevent injury.

Figure 1A:
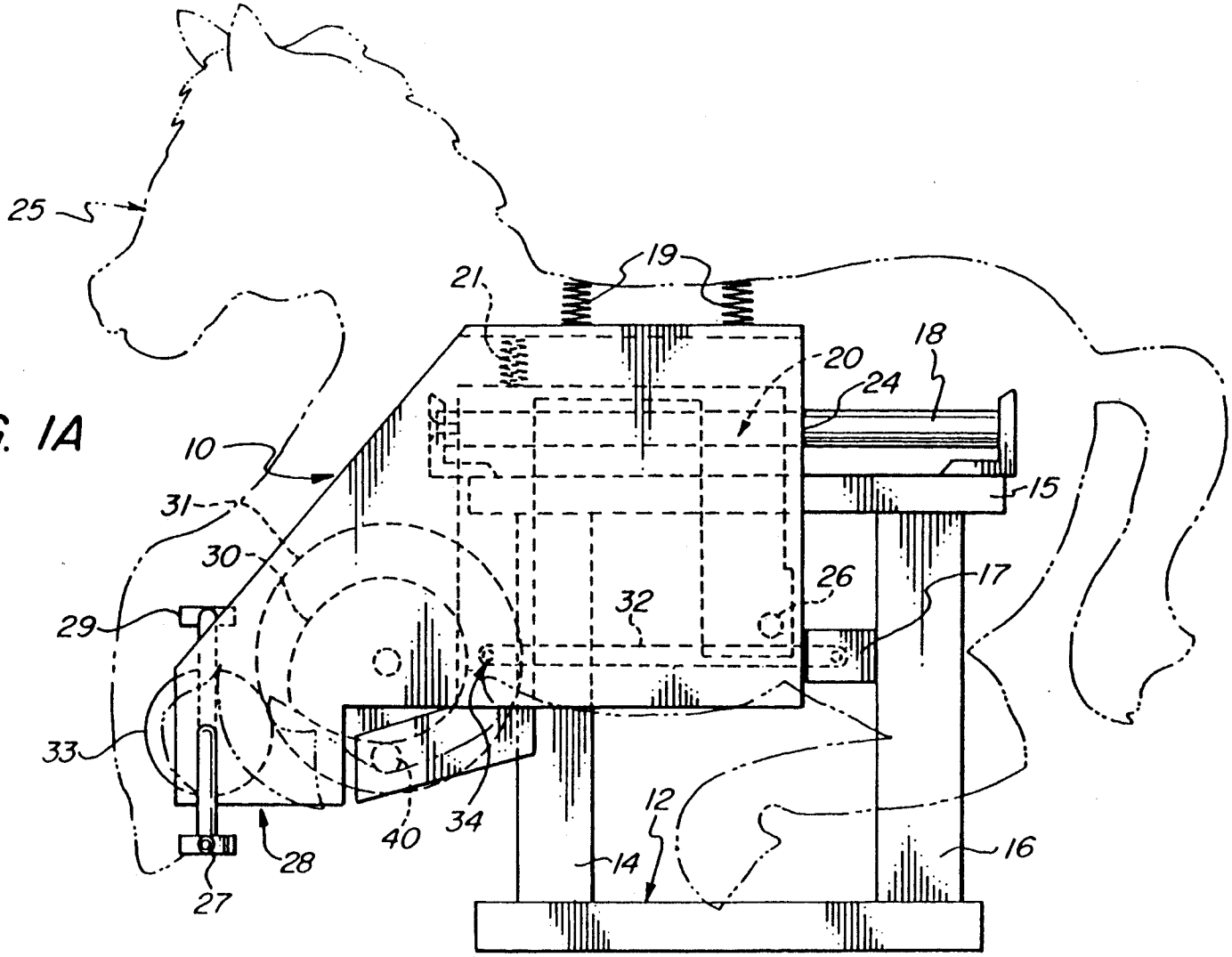
FIG. 1A is a schematic side elevational view of a riding mechanism according to one embodiment of the present invention.

There is shown in FIG. 1A the movement members of a riding toy mechanism 10 according to the present invention, which comprises a stationary support member 12 which includes a front upright portion 14 and a rear upright portion 16. In this embodiment, the first movement member is a slide member 20 which is slidably mounted to support member 12 on track means to allow slide member 20 to slide to-and-fro but to otherwise retain slide member 20 on support member 12. Such track means are exemplified in FIG. 1A as parallel slide bars 18 (one of which is not shown in FIG. 1A) suspended between and mounted upon the upright portions 14 and 16 above support beam 15 which is also mounted between upright portions 14 and 16. Slide member 20 is equipped to slidably receive slide bars 18, and can therefore reciprocatingly slide back and forth on slide bars 18. Mounted on slide member 20 is a second movement member, pivot member 24, which is configured as a shroud to rest upon and fit over slide member 20 and which is therefore subjected to the lateral reciprocating motion of slide member 20. However, pivot member 24 is pivotably mounted on slide member 20 by pivot studs 26 (only one of which is shown in FIG. 1A) at what is preferably considered to be the rear end of pivot member 24. A rotatable member such as cam 30 is rotatably and eccentrically attached to the other end of pivot member 24 (i.e., the front end) and supports pivot member 24 by resting on a cam follower 40 which is mounted on slide member 20, as will be described in further detail below. Preferably, a spring 21 is disposed between slide member 20 and pivot member 24 near the forward end of slide member 20, to reduce the force with which cam 30 bears on cam follower 40, as described below. Also shown in dotted outline, a saddle shell 25 in the shape of a horse is mounted on pivot member 24. Preferably, saddle shell 25 is mounted on springs 19 or a similar damping mechanism to provide a smooth ride.

Figure 2:
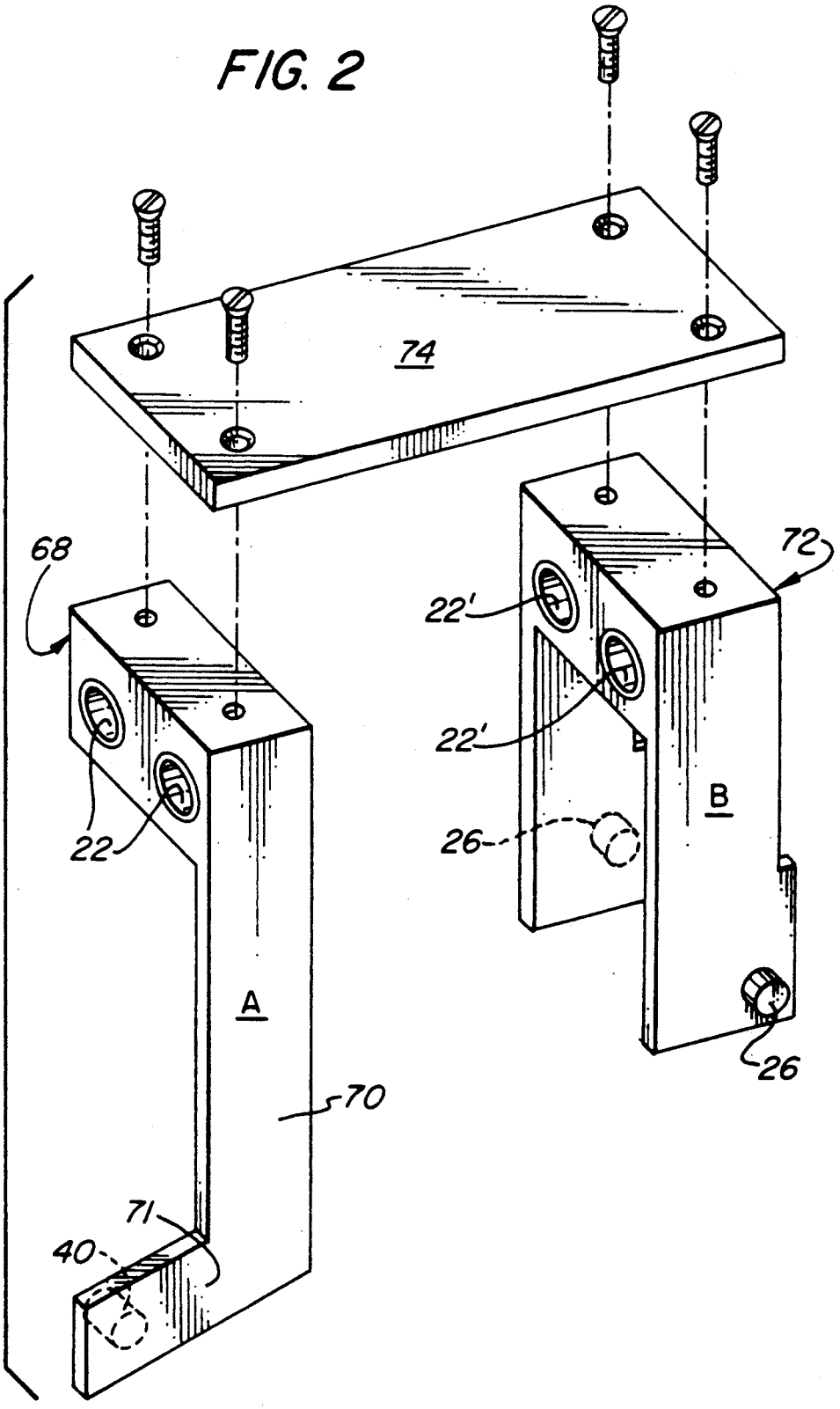
FIG. 2 is an exploded perspective view of a slide member forming part of the mechanism of FIG. 1A.

An exploded view of slide member 20 is shown in FIG. 2 with front portion 68 thereof equipped with bores 22 to accommodate slide bars 18. In addition, front portion 68 includes a leg 70 having a foot portion 71 upon which follower means such as cam follower 40 is mounted. Rear portion 72 of slide member 20 is also equipped with bores 22' to accommodate slide bars 18 and includes pivot studs 26 to accommodate pivot member 24 (not shown in FIG. 2). Front portion 68 and rear portion 72 are connected by top plate 74 attached thereto in any suitable manner such as by adhesive, welding, or mechanical attachment (i.e., screws, nuts and bolts) to provide a unitary slide member 20 in which front portion 68 and rear portion 72 will move as a unit.

Referring again to FIG. 1A, a pivot member 24 is mounted pivotably to slide member 20 at pivot studs 26. Since pivot member 24 is pivotably mounted to slide member 20, it will be subject to the same lateral reciprocating motion as slide member 20. In addition, pivot member 24 is capable of moving in a second degree of freedom, i.e., in a pivoting motion about pivot studs 26.

To allow the user to impart motion to the riding toy mechanism, the invention includes dual reciprocating means 28. The dual reciprocating means includes lateral reciprocating means for providing the to-and-fro motion, and vertical pivoting means for providing vertical pivoting motion. In the illustrated embodiment, the lateral reciprocating means includes a drive member such as drive gear 31 rotatably mounted on pivot member 24, connecting rod 32 and mooring means 17. Connecting rod 32 is pivotably and eccentrically connected (i.e., connected off-center) at one end to drive gear 31 at a connection point 34 and pivotably connected at its other end to mooring means 17 anchored on rear upright portion 16 of stationary support member 12. Alternatively, mooring means 17 may be connected to front upright portion 14, or any convenient point on stationary support member 12, or to any fixed object, such as a stake in the ground, as long as it fixes the lateral and vertical travel of the other end of connecting rod 32 and is not disposed directly beneath connection point 34. Connecting rod 32 ensures that the distance between connection point 34 on drive gear 31 and the point of connection of connecting rod 32 to mooring means 17 is kept substantially uniform. However, as drive gear 31 rotates, connection point 34 will change position relative to pivot member 24. Therefore, the mechanism will react to the rotation of drive gear 31 by forcing slide member 20 to reciprocate laterally on slide bars 18 so that pivot member 24, which is mounted thereon, can change position; thus, connection point 34 can remain in the position determined by connecting rod 32 while cam 30 rotates. Thus, when drive gear 31 is rotated about one-quarter turn, as shown in FIG. 1B, pivot member 24 has moved backward, toward rear support 16, so that connection point 34 can move forward relative to pivot member 24, as driven by drive gear 31.

Any suitable power means may be used to rotate the drive member to operate the mechanism. In this embodiment, the power means comprises pedals 27 and 29 and pedal gear 33 to which they are attached and which is engaged with drive gear 31. The pedal crank protrudes through the sides of saddle shell 25 so the user can operate the pedals by foot. Of course, alternative power means such as a motor may be coupled to drive gear 31 instead of pedals. The illustrated embodiment also comprises vertical pivoting means comprising an eccentric rotatable member such as eccentric cam 30, rotatably mounted on pivot member 24 and driven by the drive member and follower means such as cam follower 40. The vertical pivoting means provides anharmonic vertical movement to the device, as described below.

Figure 1B:
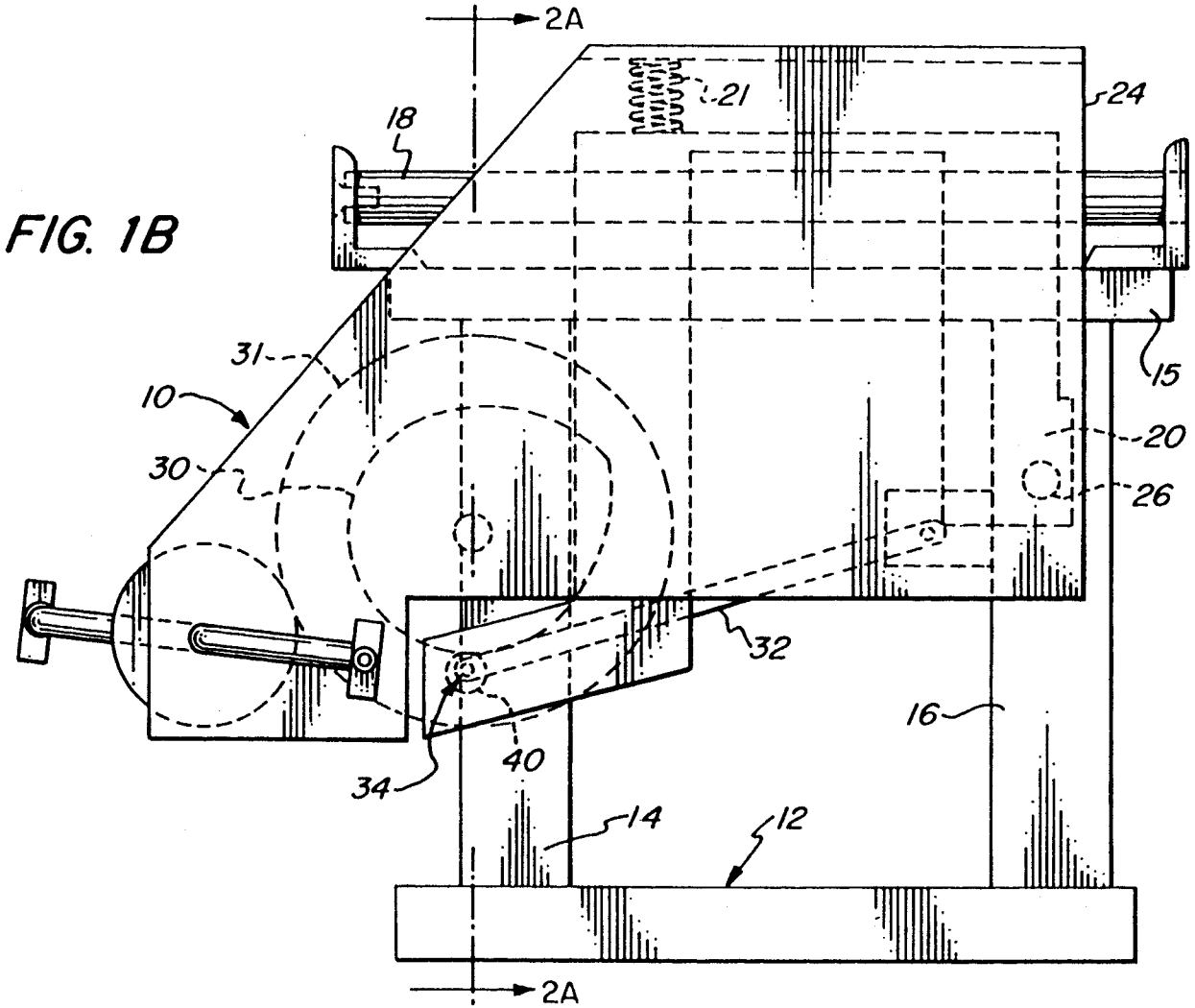
FIG. 1B is a view similar to FIG. 1A without the saddle shell, showing the drive means rotated approximately one quarter turn.
Figure 2A:
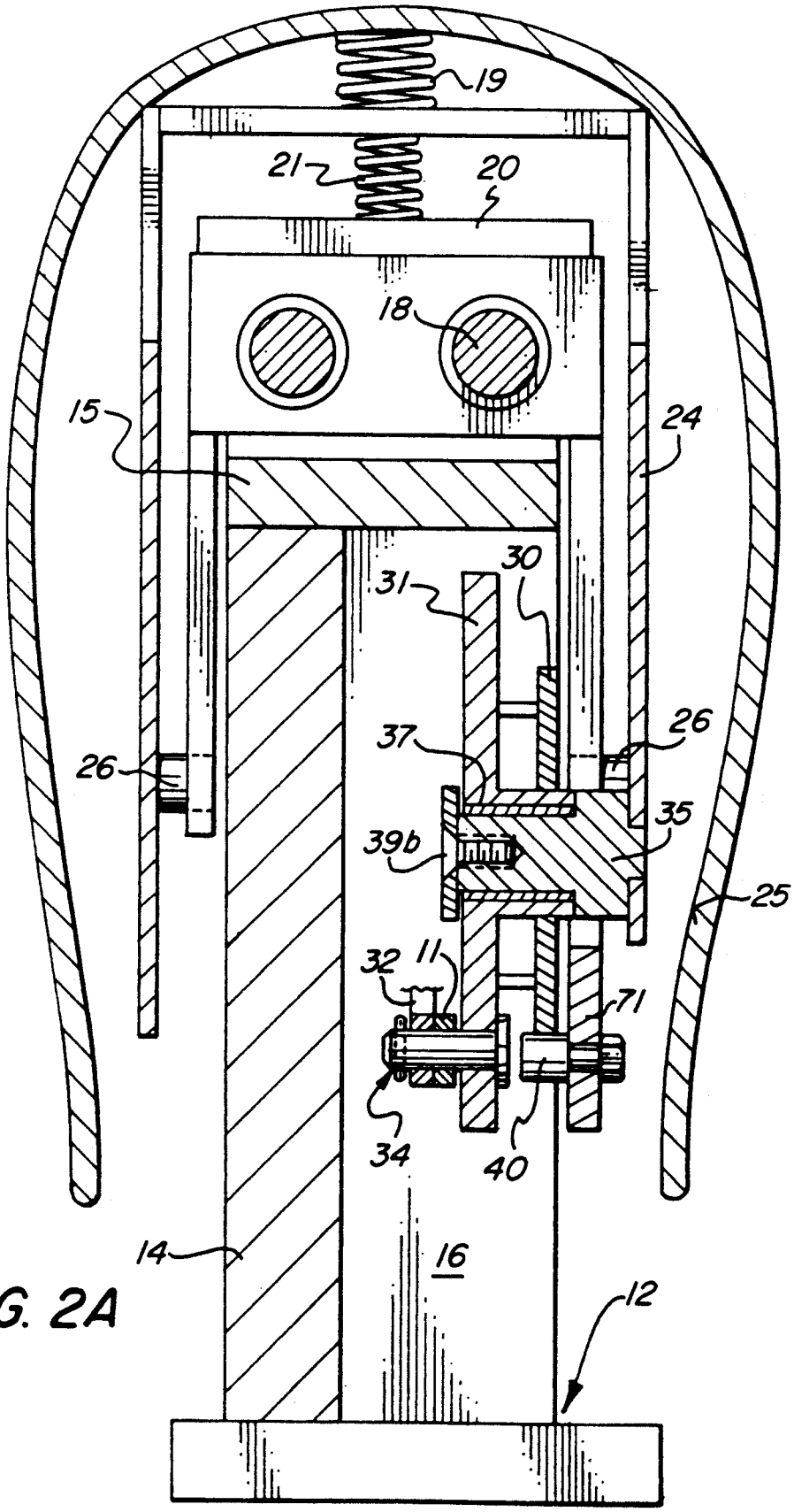
FIG. 2A is a cross-sectional view of the mechanism of FIG. 1B taken along line 2A—2A.

FIG. 2A provides a cross-sectional view of the mechanism of FIG. 1B taken along line 2A—2A. In this Figure it is clearly seen that drive gear 31 is rotatably mounted on pintle 35 by means of collar bearing 37, and that pintle 35 is fixedly attached to pivot member 24. It is also clear that eccentric cam 30 is mounted and attached to drive gear 31 and so likewise is pivotably mounted to pivot member 24. Cam 30 rests upon cam follower 40 which is mounted on foot portion 71 of slide member 20, thus supporting the front end of pivot member 24. Connecting rod 32 is pivotably attached to drive gear 31 with intervening spacer means such as washer 11 to provide clearance over bearing cover **39*b*. It will be appreciated by those skilled in the art that connecting rod 32 could be attached to cam 30 if the relative positions of drive gear 31 and cam 30 on pintle 35 were reversed. In one such case, cam follower 40 would extend further to the left in FIG. 2A, and the diameter of drive gear 31 would be reduced to avoid interference with cam follower 40**.

Referring again to FIG. 2A, it is clear that saddle shell 25 is adapted to conceal the other moving parts of the mechanism, save the pedals and pedal crank (not shown in FIG. 2A), thereby reducing the chance that the rider or a spectator might be injured by the moving parts of the mechanism of this device, and providing a more aesthetically appealing appearance. In the preferred embodiment of this invention, saddle shell 25 is equipped with a saddle for the comfort and safety of the rider and may optionally be configured to resemble a ridable object, preferably an animal, e.g., a horse, elephant, giraffe, sheep, tiger, etc. The placement of the dual reciprocating means within pivot member 24 also allows the mechanism to be close to the ground, so that a small child may easily mount the device and the risk of injury due to a fall is minimized.

Figure 3:
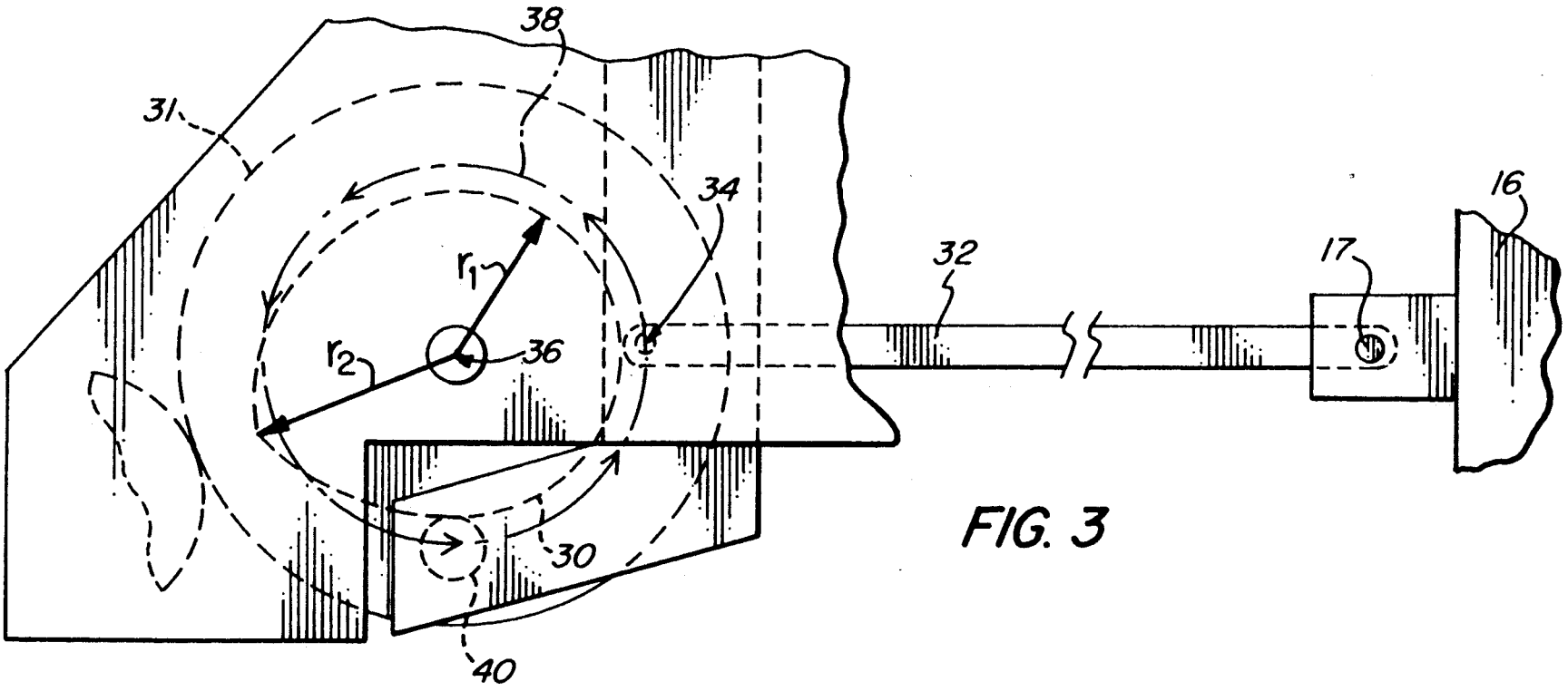
FIG. 3 is a schematic side elevational view, enlarged and with parts omitted, of the dual reciprocating means of the mechanism of FIG. 1A.

The dual reciprocating means of the riding mechanism of FIG. 1A is shown in an enlarged view in FIG. 3. When rotated by the user, drive gear 31 rotates about center of rotation 36, which effectively is where drive gear 31 is mounted to pivot member 24. As it so rotates, connection point 34 of connecting rod 32 on drive gear 31 rotates about center of rotation 36 in a substantially perfect circle of travel 38. This imparts a reciprocating motion having a substantially harmonic or sinusoidal lateral amplitude motion to slide member 20 (and to vertically reciprocating pivot member 24 mounted thereon) for each rotation of drive gear 31, due to the connection of connecting rod 32 to mooring means 17 secured to stationary support member 12 on rear upright portion 16. The amplitude of the lateral reciprocating motion will be determined by the distance from the center of rotation 36 of cam 30 to connection point 34, and the placement of mooring means 17. Unlike mechanisms of the prior art, this sinusoidal or harmonic lateral amplitude is not necessarily duplicated in the vertical direction, because the vertical motion is determined by the peripheral configuration of cam 30. Cam 30 has an eccentric peripheral configuration, i.e., it is noncircular with respect to center of rotation 36 where, like drive gear 31, it effectively is mounted to pivot member 24. Therefore, while drive gear 31 rotates to cause pivot member 24 and slide member 20 to reciprocate laterally, cam 30 rotates as well, varying the radial distance from center of rotation 36 to cam follower 40 and causing the front end of pivot member 24 to pivot up-and-down about pivot studs 26 according to the peripheral eccentricity of cam 30. The amplitude of the pivoting motion is determined by the radius of cam 30 from center of rotation 36 at the point where cam 30 rests upon cam follower 40. For example, vertical pivoting motion will be affected when center of rotation 36 rises from height $r_1$ to height $r_2$ as cam 30 rotates. Pivot member 24 pivots about pivot studs 26 accordingly. Spring 21, shown, e.g., in FIG. 1B, helps to offset the force with which cam 30 bears on cam follower 40. By so doing, spring 21 reduces the tendency of the weight of pivot member 24, saddle shell 25 and the user to cause cam 30 to be driven or to "run away" during the downward portion of the pivoting motion. Likewise, spring 21 assists the user in driving cam 30 during the upward portion of the pivoting motion by mitigating the force of gravity which opposes the upward motion. Since the harmonic lateral reciprocating motion is not effected by and does not determine the peripheral configuration of cam 30, the amplitude of the pivoting motion is thus decoupled from, or independent of, the amplitude of the lateral reciprocating motion. Thus, the novel dual reciprocating means taught herein provides lateral and vertical motions having different amplitudes, whereas in the prior art, both motions would have the same amplitude.

Figure 4:
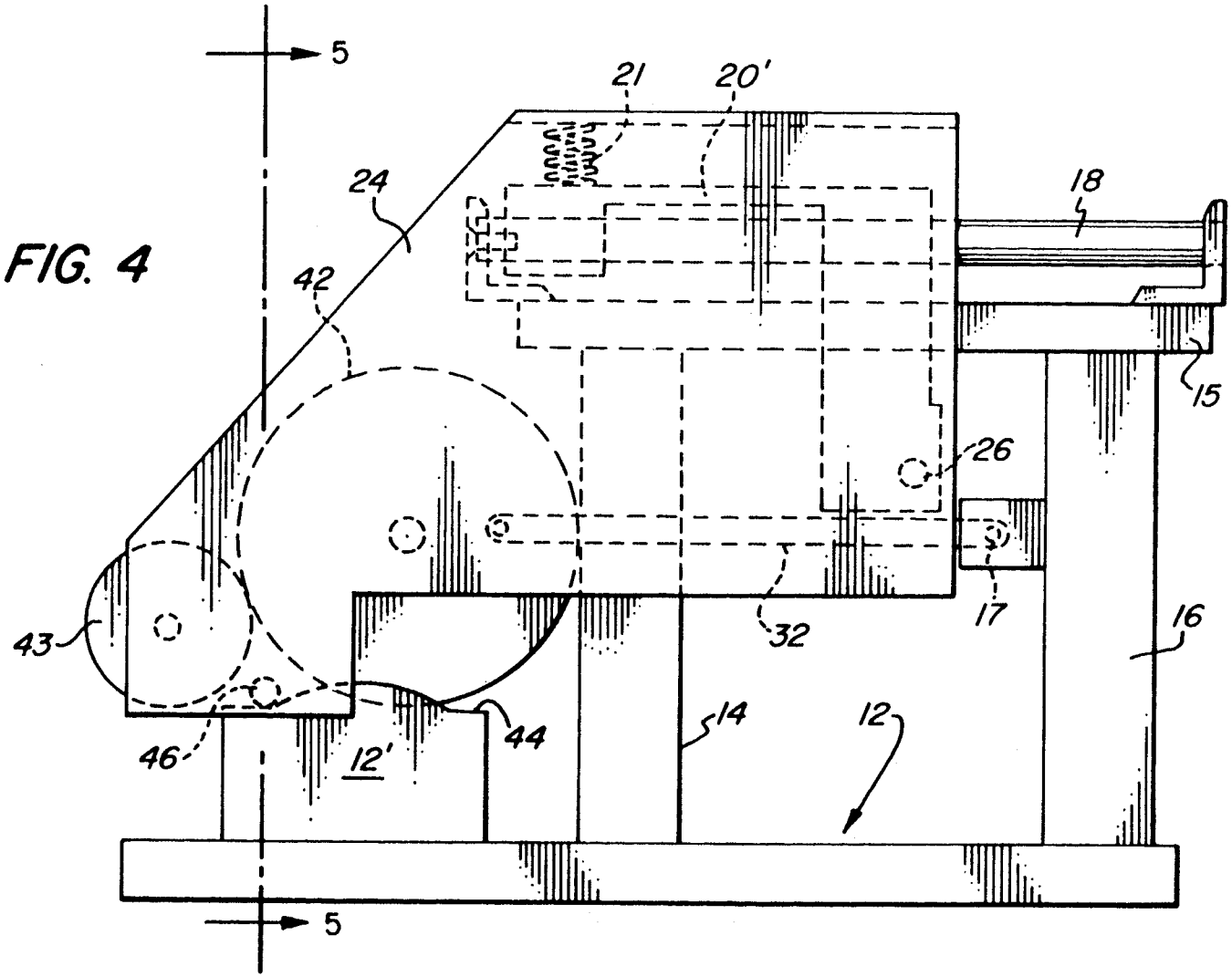
FIG. 4 is a schematic side elevational view of a riding mechanism according to another embodiment of the present invention.

In an alternative embodiment, the follower means may comprise a flat surface on the support means on which cam 30 can ride, similar to surface 44 of the embodiment of FIG. 4. It is readily apparent that in the embodiment of FIG. 3, cam 30 may be replaced with a different rotatable member such as a peripherally eccentric gear, in which cam follower 40 should be replaced with an idler gear adapted to engagably receive the teeth or sprockets of the eccentric gear.

Figure 5:
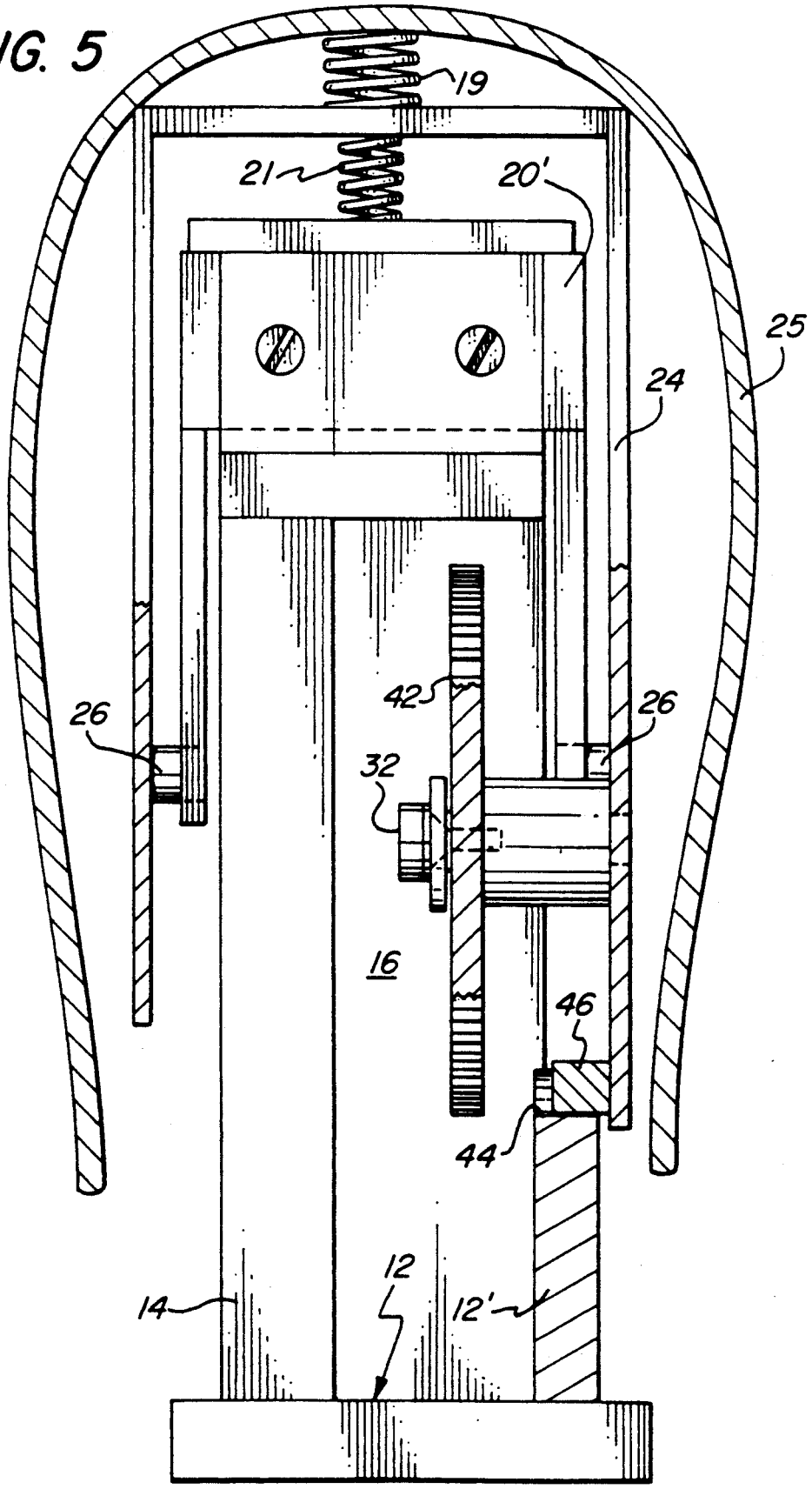
FIG. 5 is a cross-sectional view taken along line 5—5 of the mechanism of FIG. 4.

The means for decoupling the vertical and lateral reciprocating motion need not be contained in the same integral structure. For example, FIGS. 4 and 5 show an embodiment of the present invention in which the anharmonic or independent vertical motion is provided by a cam surface on the stationary support. In this embodiment, the drive member of the invention comprises drive wheel 42, which has a conventional circular periphery and is mounted on pivot member 24. Instead of pedals, electric motor 43 is mounted on pivot member 24 to turn drive wheel 42. The stationary support member 12 is equipped with a cam surface 44 on upwardly extending portion 12', and pivot member 24 is equipped with a cam follower 46 which rides up-and-down on cam surface 44 as pivot member 24 slides to-and-fro on slide member 20' in a lateral range corresponding to the lateral reciprocating motion imparted by the rotation of wheel 42. Pivot member 24 thus simultaneously pivots about pivot stud 26 (FIG. 4) in a vertical pivoting motion determined by cam surface 44 as it moves to-and-fro. In fact, wheel 42 itself may double as the cam follower by riding directly upon cam surface 44 as it rotates, thus simultaneously rotating, reciprocating laterally, and pivoting vertically about pivot stud 26. Since, in this embodiment, the front end of pivot member 24 rests directly on cam surface 44, there is no need for a leg portion on the front of slide member 20'.

Figure 6:
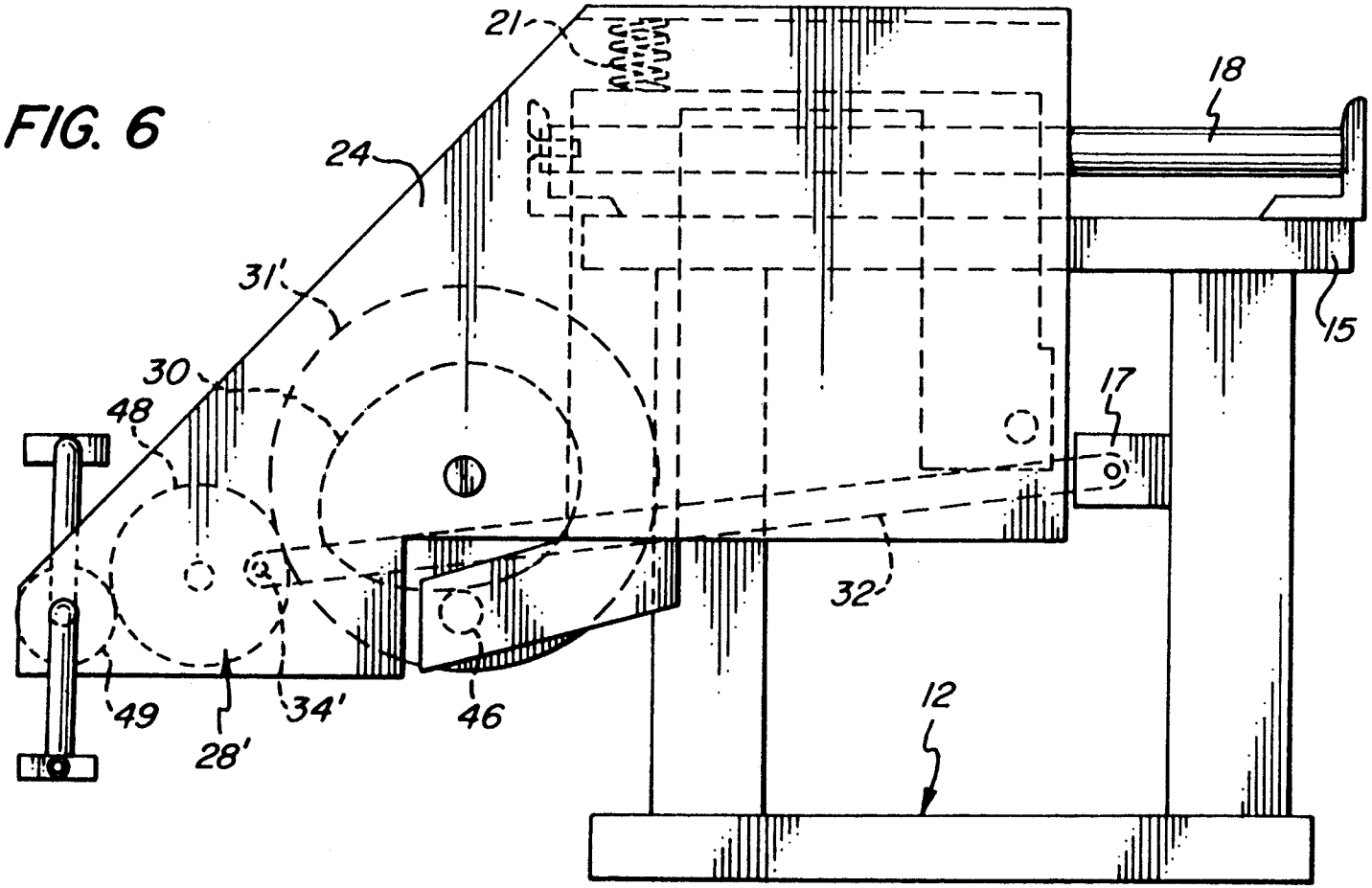
FIG. 6 is a side elevation view of yet another embodiment of a dual reciprocating means according to this invention.

In other embodiments of this invention, the dual reciprocating means may include additional gears. For example, FIG. 6 shows an embodiment in which dual reciprocating means 28' includes primary drive gear 48 pivotably mounted on pivot member 24. Connecting rod 32 is pivotably connected between eccentric connection point 34' on primary drive gear 48 and mooring means 17 on stationary support member 12. A secondary drive gear 31' is pivotably mounted to pivot member 24 in driving engagement with primary drive gear 48. Eccentric cam 30 is attached to secondary drive gear 31' and rests on cam follower 46. Upon rotation (e.g., by pedal gear 49), primary drive gear 48 and connecting rod 32 impart lateral reciprocating motion to the pivot member and the slide member. When secondary drive gear 31' has the same diameter as primary drive gear 48, one full rotation of primary drive gear 48 will cause eccentric cam 30 to rotate also in one complete cycle, thereby imparting a full period of eccentric vertical pivoting to pivot member 24 relative to slide member 20 and stationary support member 12 (not shown). Alternatively, secondary drive gear 31' may be of a different diameter than primary drive gear 48, with the result that a full period of lateral reciprocating motion will be accompanied by either a fraction of a cycle of vertical pivoting motion, in the case where conventional secondary drive gear 31' is of greater diameter than primary drive gear 48, or more than a complete cycle of vertical pivoting motion, in the case where secondary drive gear 31' has a smaller diameter than primary drive gear 48. Preferably, the drive ratio between primary drive gear 48 and secondary drive gear 31' is chosen to allow a child to easily operate the mechanism by pumping the pedals. Also, eccentric cam 30 is shaped with a smooth eccentric contour to avoid jarring the rider and to avoid the need for sudden or substantial increases in driving force.

Figure 7:
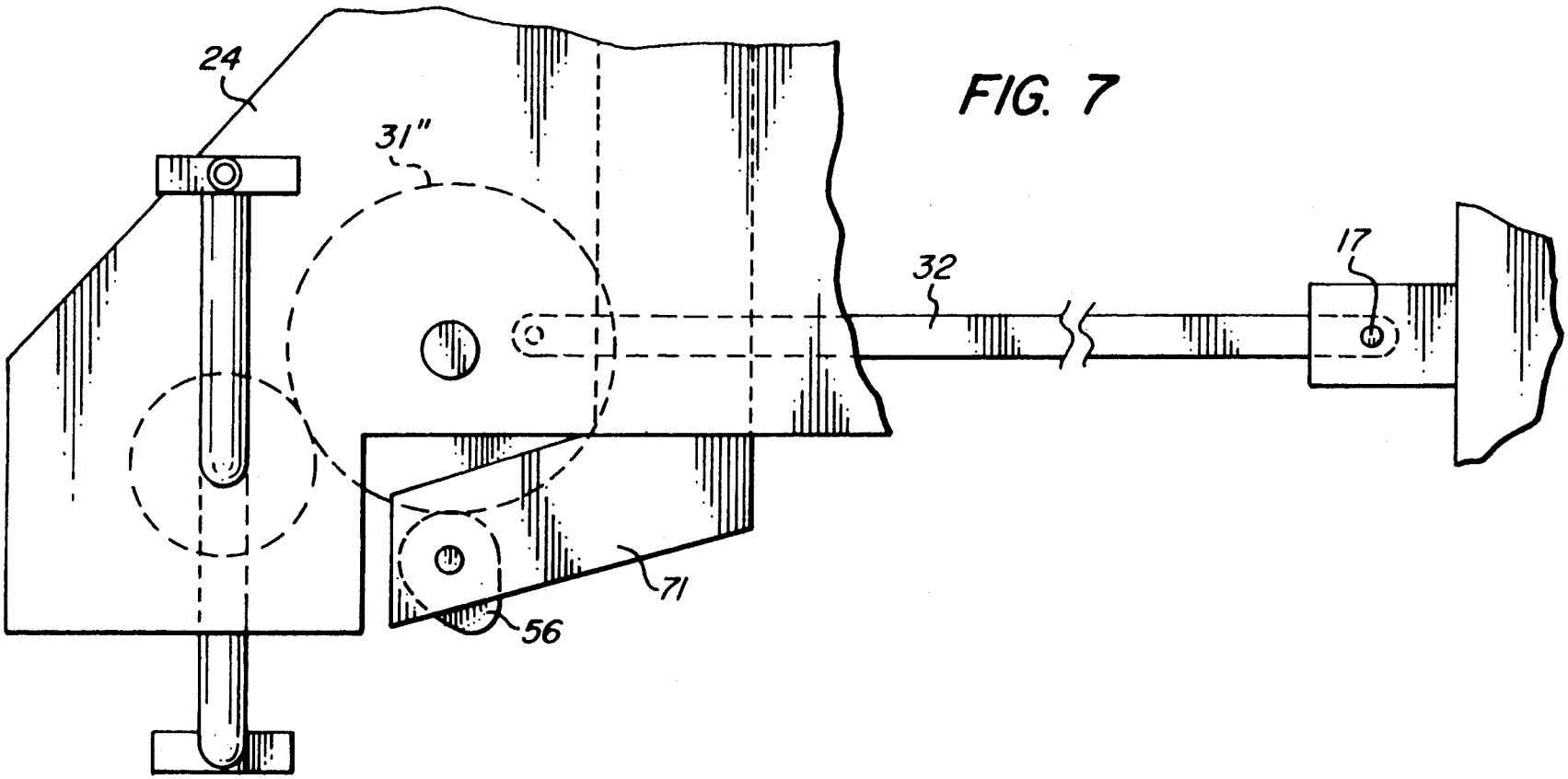
FIG. 7 is a schematic side elevational view of yet another embodiment of a dual reciprocating means according to the present invention.

A result similar to that obtained in FIG. 4 may be achieved with the apparatus shown in FIG. 7 in which drive gear 31'', mounted to pivot member 24 (partially shown) rests upon an eccentric idler gear 56 which is pivotably mounted on foot portion 71 of slide member 20. It is readily seen from the Figure that the amplitude of the vertical pivoting motion imparted to pivot member 24 will be determined by the eccentric peripheral configuration of eccentric idler gear 56. In addition, the periodicity of the vertical pivoting motion in its relation to the period of lateral reciprocating motion will be dependent upon the relative proportions of the circumferences of the drive gear 31'' and eccentric idler gear 56.

Figure 8:
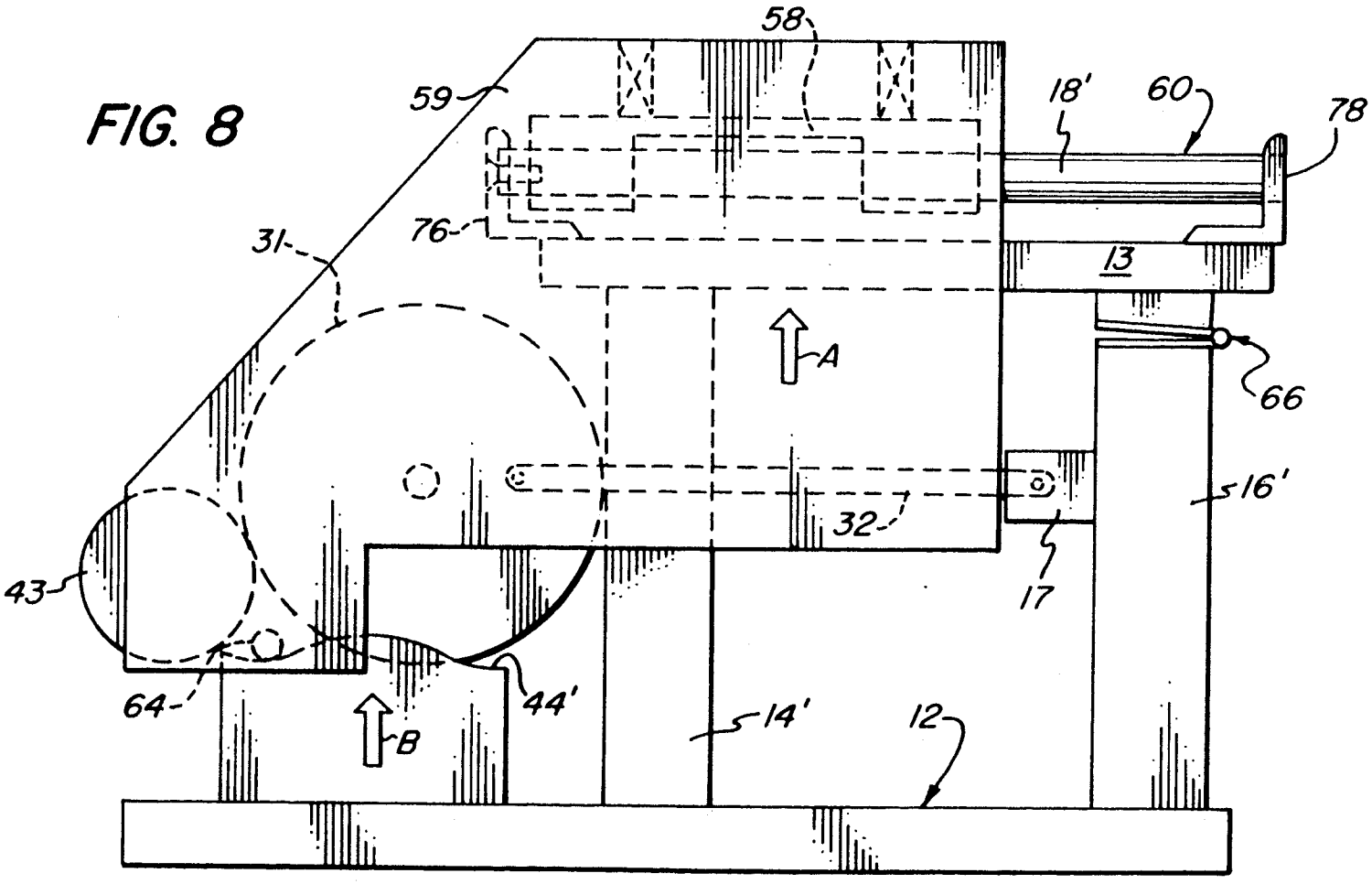
FIG. 8 is a schematic side elevational view of a riding mechanism according to yet another embodiment of the present invention.

In accomplishing the goals of this invention, it is not necessary that the pivot member ride on the slide member. In an alternate configuration exemplified in FIG. 8, alternate pivot member 60 includes track means, such as slide bars 18', and frame members 76 and 78 which are mounted on support beam 13 which is pivotably attached to rear upright portion 16' of stationary support member 12 by hinge means 66, and which rests upon but is not affixed to front upright portion 14'. Slide support 58 is slidably mounted to slide bars 18' and carries alternate slide member 59. Drive gear 31 is rotatably mounted to alternate slide member 59 and is engaged with motor 43 which is also mounted to alternate slide member 59. Connecting rod 32 is pivotably attached at one end to drive gear 31 and at the other end to mooring means 17. Alternate slide member 59 is equipped with a cam follower 64 which rests upon cam surface 44' on stationary support member 12. In this embodiment, the user rides upon alternate slide member 59, which, like other embodiments, may carry an aesthetically pleasing saddle shell. By running motor 43, the user forces alternate slide member 59 to reciprocate to-and-fro on slide bars 18' of alternate pivot member 60. As it does, cam follower 64 follows a vertical displacement profile determined by cam surface 44', causing alternate pivot member 60 to pivot anharmonically about hinge means 66, thus rising from front upright portion 14', as indicated by arrow A near the top of upright portion 14' and by corresponding arrow B at the apex of cam surface 44'. Optionally, a spring may be disposed between upright portion 14' and support beam 13 to improve the operation of the mechanism as described in connection with the embodiment of FIG. 1A above. Alternatively, drive gear 31 may rest directly on cam surface 44', thus doubling as a cam follower in place of cam follower 64. Drive gear 31 may have a regular or an eccentric peripheral configuration.

While some features of this invention are shown with respect to some embodiments and not with others, this is not intended as a limitation of this invention. The invention is intended to encompass embodiments in which the various mechanical elements are adjustable and thus allow for variable motions without removing the elements in question. Other objects, features and embodiments of this invention will now occur to those skilled in the art, and are intended to fall within the scope of the following claims.

What is claimed is:

1. A riding mechanism comprising:

a stationary support means;

a slide member slidably mounted on the mechanism;

a pivot member pivotably mounted on the mechanism;

dual reciprocating means, engaged with power means defined below, for simultaneously imparting lateral reciprocating motion to at least the slide member and independently imparting vertical pivoting motion to at least the pivot member, thereby imparting a compound motion to one of the slide member and the pivot member in which the amplitude of the vertical pivoting motion is independent from the amplitude of the lateral reciprocating motion; and power means mounted on the mechanism and engaged with the dual reciprocating means, for operating the mechanism.

2. The riding mechanism of claim 1 wherein the slide member is slidably mounted on the support means and the pivot member is pivotably mounted on the slide member.

3. The riding mechanism of claim 1 wherein the pivot member is pivotably mounted to the support means and the slide member is slidably mounted on the pivot member.

4. The riding mechanism of claim 1 wherein the dual reciprocating means comprises a drive member rotatably mounted on the pivot member, an eccentric rotatable member rotatably mounted on the pivot member and coupled to the drive member whereby rotation of the drive means causes rotation of the eccentric rotatable member, a connecting rod having two ends, one end being pivotably and eccentrically attached to one of the eccentric rotatable member and the drive member and the other end being pivotably attached to a mooring means, to impart regular lateral reciprocating motion to the slide member upon rotation of the drive member, the dual reciprocating means further comprising follower means mounted on one of the slide member and the support means in engagement with the periphery of the eccentric rotatable member, whereby rotation of the eccentric rotatable member caused by rotation of the drive means imparts said vertical pivoting motion to the pivot member.

5. The riding mechanism of claim 4 wherein the eccentric rotatable member is a cam and wherein the riding mechanism comprises cam follower means mounted on one of the slide member and the support means.

6. The riding mechanism of claim 4 wherein the eccentric rotatable member is a gear and wherein the follower means is an idler gear mounted on the slide member for engaging and bearing the rotatable member.

7. The riding mechanism of claim 6 wherein the idler gear has an eccentric periphery.

8. The riding mechanism of claim 2 wherein the dual reciprocating means comprises a drive member rotatably mounted on the pivot member, a connecting rod having two ends with one end pivotably and eccentrically attached to the drive member and the other end pivotably attached to a mooring means to provide lateral reciprocating motion to the slide member, and further comprises a cam surface on the support means and a cam follower mounted on the pivot member, the cam follower riding on the cam surface when the rotatable drive member rotates to provide vertical pivoting motion to the pivot member.

9. The riding mechanism of claim 8 wherein the cam follower is the drive member.

10. The riding mechanism of claim 1 wherein the dual reciprocating means comprises:

lateral reciprocating means operably disposed between a mooring means and one of the slide member and the pivot member for imparting said lateral reciprocating motion; and vertical pivoting means operably disposed between the pivot member and one of the slide member and the stationary support means, for imparting said vertical pivoting motion in response to the operation of the lateral reciprocating means.

11. The riding mechanism of claim 10 wherein the lateral reciprocating means comprises a drive member rotatably mounted on one of the pivot member and the slide member and further comprises connecting means having two ends with one end pivotably and eccentrically attached to the drive member and the other end pivotably attached to the mooring means.

12. The riding mechanism of claim 11 wherein the drive member is a gear and wherein the vertical pivoting means comprises a peripherally eccentric cam rotatably mounted on one of the pivot member and the slide member in driving relation to the gear.

13. The riding mechanism of claim 12 wherein the drive member is a driving gear mounted on the pivot member and the vertical pivoting means comprises an eccentric idler gear mounted on the slide member and engaged with the driving gear.

14. The riding mechanism of claim 2 wherein the support means comprises track means adapted to slidably receive the slide member.

15. The riding mechanism of claim 3 wherein the pivot member comprises track means adapted to slidably receive the slide member.

16. The riding mechanism of claim 2 wherein the dual reciprocating means comprises a cam follower on the pivot member and a cam surface on the support means.

17. The riding mechanism of claim 1, claim 4, claim 8 or claim 11 wherein the power means comprises a pedal gear engaged with the dual reciprocating means and pedals mounted on the pedal gear to allow the user to operate the mechanism by foot.

18. The riding mechanism of claim 1, claim 4, claim 8 or claim 11 wherein the power means comprises a motor engaged with the dual reciprocating means.

* * * * *